US007137463B2

(12) United States Patent
Beaton

(10) Patent No.: US 7,137,463 B2
(45) **Date of Patent: *Nov. 21, 2006**

(54) POLYCRYSTALINE DIAMOND COMPACT INSERT REAMING TOOL

(75) Inventor: Timothy P. Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 109 days.

This patent is subject to a terminal disclaimer.

(21) Appl. No.: 10/633,796

(22) Filed: Aug. 4, 2003

(65) Prior Publication Data

US 2004/0206552 A1 Oct. 21, 2004

Related U.S. Application Data

(63) Continuation of application No. 10/141,448, filed on May 8, 2002, now Pat. No. 6,609,580, which is a continuation of application No. 09/392,920, filed on Sep. 9, 1999, now Pat. No. 6,386,302.

(51) Int. Cl.
*E21B 10/26* (2006.01)
*E21B 10/30* (2006.01)
*E21B 10/40* (2006.01)

(52) U.S. Cl. ..... 175/406; 175/335; 175/391

(58) Field of Classification Search ..... 175/385, 175/391, 398, 406, 348, 335, 334, 408
See application file for complete search history.

(56) References Cited

U.S. PATENT DOCUMENTS 4,031,974 A * 6/1977 Peterson ..... 175/334
5,678,644 A * 10/1997 Fielder ..... 175/391
5,765,653 A * 6/1998 Doster et al. ..... 175/75
5,992,548 A * 11/1999 Silva et al. ..... 175/391
6,213,229 B1 * 4/2001 Majkovic ..... 175/325.2
6,269,893 B1 * 8/2001 Beaton et al. ..... 175/391
6,386,302 B1 * 5/2002 Beaton ..... 175/406
6,397,958 B1 * 6/2002 Charles et al. ..... 175/391
6,464,024 B1 * 10/2002 Beaton et al. ..... 175/391
6,494,272 B1 * 12/2002 Eppink et al. ..... 175/57
6,606,923 B1 * 8/2003 Hart et al. ..... 76/108.2
6,695,080 B1 * 2/2004 Presley et al. ..... 175/391

FOREIGN PATENT DOCUMENTS

WO WO 93/25794 A1 * 12/1993

* cited by examiner
n

*Primary Examiner*—Jennifer H. Gay
(74) *Attorney, Agent, or Firm*—Osha Liang LLP

(57) ABSTRACT

A reaming tool that includes a body having reaming blades affixed thereto. The reaming blades each have at least one cutter attached thereto at a selected position and orientation. The plurality of reaming blades includes at least one radially most extensive reaming blade. The reaming tool further includes a pilot blade azimuthally spaced apart from the at least one radially most extensive reaming blade. The pilot blade is affixed to the body longitudinally ahead of the at least one radially most extensive reaming blade.

6 Claims, 3 Drawing Sheets

POLYCRYSTALINE DIAMOND COMPACT INSERT REAMING TOOL

CROSS REFERENCE TO RELATED APPLICATIONS

This application is a continuation of U.S. patent application Ser. No. 10/141,448 filed on May 8, 2002, which issued as U.S. Pat. No. 6,609,580 and which claims benefit of U.S. patent application Ser. No. 09/392,920, filed Sep. 9, 1999, which issued as U.S. Pat. No. 6,386,302. These patents are herein incorporated by reference.

STATEMENT REGARDING FEDERALLY SPONSORED RESEARCH OR DEVELOPMENT

Not applicable.

BACKGROUND OF INVENTION

1. Field of the Invention

The invention is related generally to the field of reaming tools used to enlarge the diameter of wellbores drilled through the earth beyond the diameter of a drill bit used to initially drill the wellbore through earth.

2. Background Art

Drill bits used to drill wellbores through earth formations typically have a nominal diameter, that is, a diameter of a borehole that will be created when the drill bit is rotated and impressed axially onto the formations. Frequently it is desirable to enlarge the diameter of the borehole beyond the nominal diameter of the drill bit. Specialized drill bits, known as bi-center bits, have been developed to create boreholes having drilled diameters greater than the diameter of an opening through which such bits will pass when they are not rotated. Other tools for enlarging a borehole beyond the nominal diameter of a symmetric bit (one whose drill diameter is substantially the same as its nominal diameter) include reamer wings. Reamer wings are typically assembled to a drilling tool assembly (drill string) at a selected axial position behind (away from the drilling surface) the drill bit. Reamer wings have cutting elements positioned on blades which extend radially outward from the rotational center of the drill string to a greater distance therefrom than the radius of the drill bit. When the reamer wing is rotated, the cutting elements drill the enlarged borehole.

Reamer wings are described for example in U.S. Pat. No. 5,495,899 issued to Pastusek et al, U.S. Pat. No. 5,497,842 issued to Pastusek et al, and U.S. Pat. No. 5,765,653 issued to Doster et al. Reamer wings typically include a tubular housing or body having a number of longitudinally extensive, azimuthally spaced apart, and generally radially-extending blades. The blades having cutting elements on them. The cutting elements are typically polycrystalline diamond compact inserts, carbide inserts or a combination of these. The reamer wings known in the art are susceptible to drilling a borehole in which the surface of the borehole is not smooth and round. Further, the reaming wings known in the art are susceptible to damage to the cutting elements affixed to the blades. Still further, the reamer wings known in the art are typically unable to drill out equipment used to cement a steel a casing in place in the borehole (float equipment) without damage to the cutting elements on the blades.

SUMMARY OF INVENTION

One aspect of the invention is a reaming tool including a body having reaming blades affixed to the body at azimuthally spaced apart locations. The reaming blades have cutters attached to them at selected positions. An outermost surface of each one of the reaming blades conforms to a radially least extensive one, with respect to the longitudinal axis of the reaming tool, of a pass through circle and a drill circle. The drill circle is substantially coaxial with the longitudinal axis. The pass-through circle is axially offset from the drill circle and defines an arcuate section inside which the pass-through circle extends from the longitudinal axis beyond the lateral extent of the drill circle, so that radially outermost cutters disposed on the reaming blades positioned azimuthally within the arcuate section will drill a hole having a drill diameter substantially twice a maximum lateral extension of the reaming blades from the longitudinal axis, while substantially avoiding wall contact along an opening having a diameter of the pass through circle. In one embodiment of this aspect of the invention, the reaming blades positioned azimuthally outside the arcuate section include wear resistant inserts on their outermost surfaces. In one example, the inserts are tungsten carbide, polycrystalline diamond or the like.

Another aspect of the invention is a reaming tool including a body having reaming blades affixed to them at azimuthally spaced apart locations. The reaming blades have cutters attached to them at selected positions along each one of the reaming blades. In this aspect of the invention, the reaming tool includes a pilot hole conditioning section having a plurality of azimuthally spaced apart blades ("Pilot blades") affixed to the body longitudinally ahead of the reaming blades. The pilot blades include a taper on their downhole ends, a gauge pad having a diameter substantially equal to a drill diameter of a pilot bit used to drill a pilot hole longitudinally ahead of the reaming tool, and an intermediate cutter affixed to selected ones of the pilot blades longitudinally behind the gauge pad. The intermediate cutters are positioned laterally so as to drill a hole having an intermediate diameter larger than the pilot hole diameter and smaller than a drill diameter of the reaming tool. The pilot blades include an intermediate gauge pad axially "uphole" of the intermediate cutters, if used, these gauge pads having a diameter substantially equal to the intermediate diameter.

Another aspect of the invention is a reaming tool including a body having reaming blades affixed to the body at azimuthally spaced apart locations around the circumference of the body. The reaming blades each have at least one cutter attached to them at a selected position along each of the blades, the position and/or orientation of the cutter selected to minimize lateral force imbalance of the reaming tool. One embodiment of this aspect of the invention includes a pilot hole conditioning section having a plurality of azimuthally spaced apart pilot blades affixed to the reaming tool body longitudinally ahead of the reaming blades.

Another aspect of the invention is a reaming tool including a body having reaming blades affixed to the body at azimuthally spaced apart locations around a circumference of the body. Selected ones of the reaming blades include cutters attached to them at selected positions. In this aspect of the invention, the reamer includes a pilot hole conditioning section, including a plurality of azimuthally spaced apart pilot blades affixed to the reamer body longitudinally ahead of the reaming blades. At least one of the reaming blades is formed as a single structure with an azimuthally corresponding one of the pilot blades.

Another aspect of the invention is a reaming tool including a plurality of reaming blades affixed to a body at azimuthally spaced apart locations. Selected ones of the reaming blades are formed as spirals.

Another aspect of the invention is a reaming tool including a body having reaming blades affixed to the body at azimuthally spaced apart locations around a circumference of the body. Selected ones of the reaming blades include cutters on them at selected positions. The reaming tool in this aspect also includes a pilot hole conditioning section having a plurality of azimuthally spaced apart pilot blades affixed to the body longitudinally ahead of the reaming blades. The pilot blades each include a taper on the downhole end of the blade, a gauge pad having a diameter substantially equal to a drill diameter of a pilot bit used to drill a pilot hole longitudinally ahead of the reaming tool, and at least one intermediate cutter affixed to selected ones of the pilot blades longitudinally behind the gauge pad. The at least one intermediate cutter is laterally positioned to drill a hole having an intermediate diameter larger than the pilot hole and smaller than a drill diameter of the reaming tool. Selected ones of the pilot blades include an intermediate gauge pad having a diameter substantially equal to the intermediate diameter. At least one of a position and an orientation of the at least one intermediate cutter is selected so that net lateral force generated by the reaming tool is within about twenty percent of the axial force (weight on bit) applied to the reaming tool. In another embodiment, the net lateral force is within about 15 percent of the axial force on the reaming tool (weight on bit). In a particular embodiment of this aspect of the invention, the pilot blades include a taper on the downhole edge. Selected ones of the tapers can include an auxiliary cutter thereon.

Other aspects and advantages of the invention will be apparent from the following description and the appended claims.

DETAILED DESCRIPTION

Figure 1:
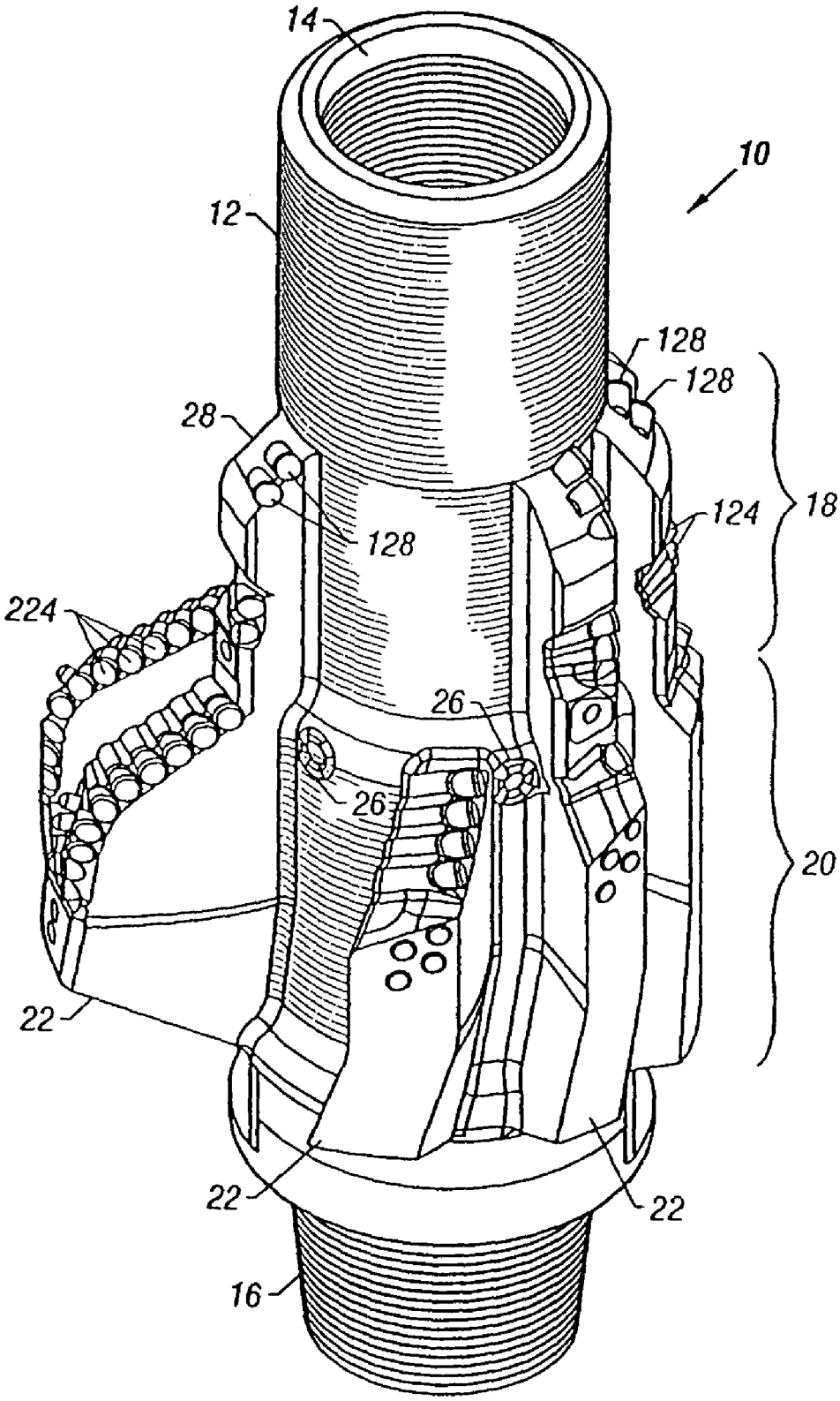
FIG. 1 shows an oblique view of one example of a reaming tool.

One example of a reaming tool is shown in FIG. 1 at 10. The reaming tool 10 is formed on a body 12 made of high-strength material. The body 12 is adapted to be coupled to a rotary wellbore drill string (not shown), preferably by means of threaded connections 14, 16 machined or otherwise formed into the longitudinal ends of the body 12. The body 12 includes a plurality of azimuthally spaced apart blades 22 formed therein or otherwise affixed to the body 12. Some of the blades 22 include cutters 124, 224 positioned thereon at spaced apart locations. The cutters 124, 224 are preferably polycrystalline diamond compact (PDC) inserts or the like, but other types of cutters such as carbide cutters will work with the invention. The reaming tool 10 includes a plurality of drilling fluid discharge orifices 26 to provide drilling fluid flow during drilling operations to cool the reaming tool 10 and to wash away drill cuttings as earth formations (not shown) are deformed by the cutters 124, 224.

Generally speaking, the reaming tool 10 can be divided into a pilot hole conditioning section 18 and a reaming section 20 each of which will be explained in more detail. One purpose of the hole conditioning section 18 is to provide a round, smooth borehole which acts as a thrust surface against which the cutters 224 in the reaming section 20 can push, so that the reaming section 20 drills a hole having a diameter (referred to as the "drill diameter") which is larger than the diameter of an opening through which the reaming tool 10 can freely pass (this diameter referred to as the "pass-through diameter"). These diameters will be further explained. Another purpose of the pilot hole conditioning section 18 is to provide lateral force which balances the lateral forces exerted by the cutters 224 on the reaming section 20, as will be further explained.

Figure 2:
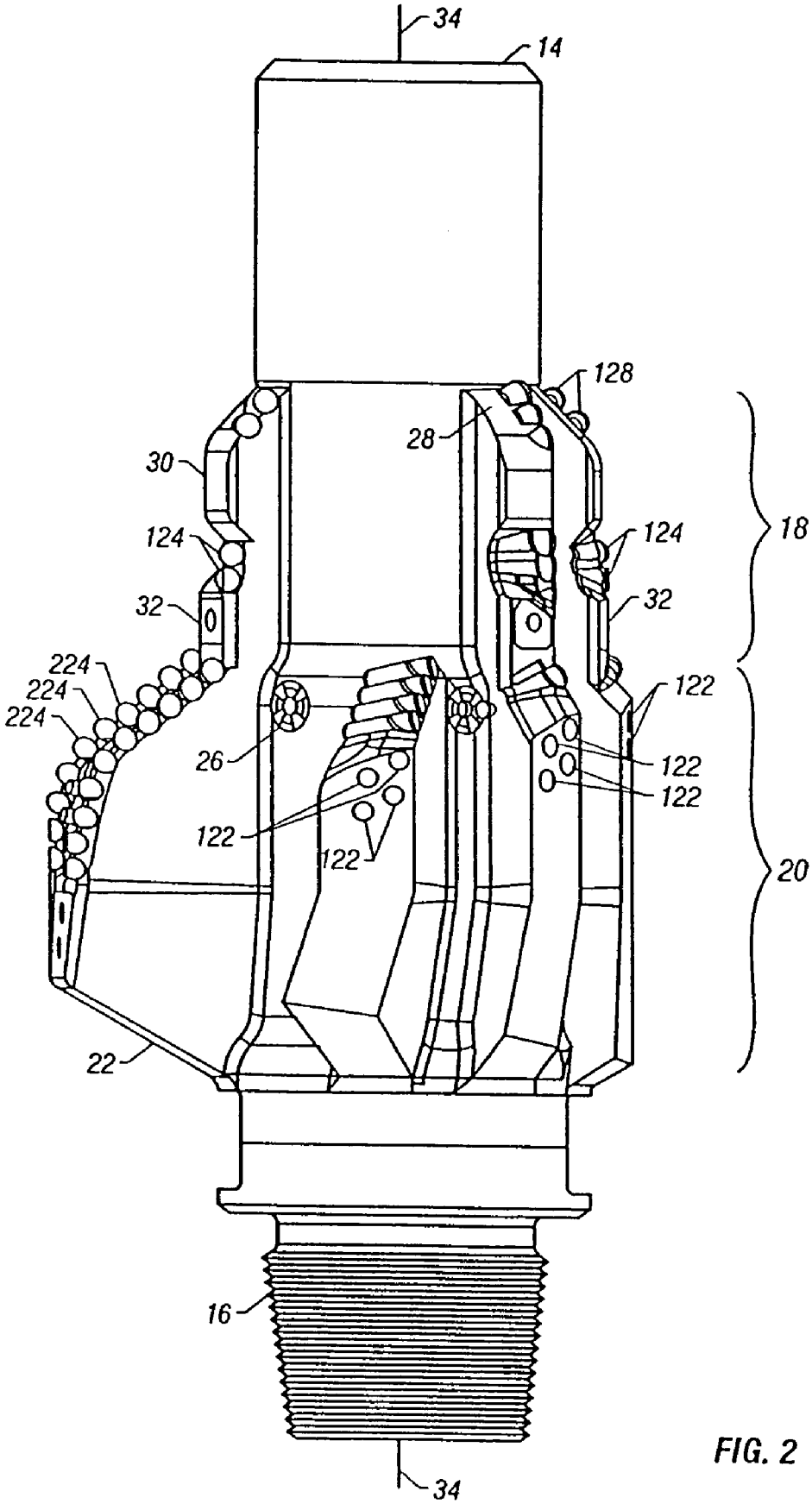
FIG. 2 shows a side view of the example reaming tool shown in FIG. 1.

A side view of the example reaming tool 10 is shown in FIG. 2. The blades 22 in the pilot hole conditioning section 18 each include on their "downhole" ends (ends nearest threaded connection 14) a taper 28. Threaded connection 14 is referred to as the downhole end since it is in the direction of a pilot bit (not shown) which can be directly attached to threaded connection 14 or can be indirectly attached thereto. The pilot bit (not shown) as is understood by those skilled in the art, drills a "pilot" hole having a nominal diameter less than the drill diameter of the reaming tool 10. See for example, T. M. Warren et al, *Simultaneous Drilling and Reaming with Fixed Blade Reamers*, paper no. 30474, Society of Petroleum Engineers, Richardson, Tex. (1995). The tapers 28 align the reaming tool 10 with the hole drilled by the pilot bit (not shown). In the case where the pilot bit (not shown) is not attached directly to the reaming tool 10, and is therefore axially separated from the reaming tool 10 by a substantial distance, it is preferable to include auxiliary cutters 128 on the tapers 28 to facilitate alignment of the reaming tool 10. Including the auxiliary cutters 128 on the tapers 28 enables easy passage of the reaming tool 10 along the pilot hole when the longitudinal axis 34 of the reaming tool 10 is not aligned with the pilot hole due to flexure in the drill string between the pilot bit (not shown) and the reaming tool 10. The auxiliary cutters 128 also enhance the ability of the reaming tool 10 to properly drill through special equipment ("float equipment") used to cement a steel pipe or casing into a wellbore. Prior art reamer wings did not have good ability to drill through such float equipment without some damage to the casing or to the prior art reamer wing. The numbers of, and azimuthal locations of the blades in the pilot hole conditioning section 18 are not meant to limit the invention, but as a practical matter, the reaming tool 10 will perform better if the blades are azimuthally distributed around the circumference of the pilot hole conditioning section 18 in a way which substantially maintains the axial position of the reaming tool 10 concentrically within the pilot hole. It is clearly within the contemplation of this aspect of the invention, for example, that two pilot hole conditioning blades spaced 180 degrees apart, or three pilot hole conditioning section blades spaced 120 degrees apart azimuthally in the pilot hole conditioning section 18 will result in adequate performance of the reaming tool 10

Pilot gauge pads 30 in the pilot hole conditioning section 18 help to maintain axial alignment of the reaming tool 10 in the pilot hole. As is known in the art, pilot holes can be enlarged beyond the diameter of the pilot bit (not shown), out of round, rugose, or otherwise not form a smooth cylindrical surface. This is particularly the case when the pilot bit (not shown) is the roller cone type, as is known in the art. One aspect of the invention is the inclusion of cutters 124 in the pilot hole conditioning section 18. The pilot hole conditioning section cutters 124 are positioned to drill a hole having a slightly larger diameter than the nominal diameter of the pilot bit (not shown). For example, if the pilot bit (not shown) has an 8.5 inch (215.9 mm) diameter, the cutters 124 can be laterally positioned along the pilot hole conditioning section blades to drill an intermediate pilot hole having approximately 9 inch (228.6 mm) diameter. The intermediate pilot hole diameter can be maintained by intermediate gauge pads 32 positioned axially "uphole" (away from the pilot bit) from the pilot hole conditioning section cutters 124. The pilot hole conditioning section cutters 124, and the intermediate gauge pads 32, provide a smooth, round, selected diameter thrust surface against which the reaming section 20 can then drill a hole having the selected drill diameter of the reaming tool 10. The example diameters for the pilot hole and intermediate pilot hole are only meant as examples and are not meant to limit this aspect of the invention.

The positions and orientations of the pilot hole conditioning section cutters 124 on the pilot blades are preferably selected to provide a lateral force which nearly matches in magnitude and offsets in azimuthal direction, a net lateral force exerted by all the cutters 224 on the reaming section 20. Methods for selecting positions and orientations to achieve the desired force balance are known in the art. See for example, T. M. Warren et al, *Drag Bit Performance Modeling*, paper no. 15617, Society of Petroleum Engineers, Richardson, Tex., 1986.

Figure 3:
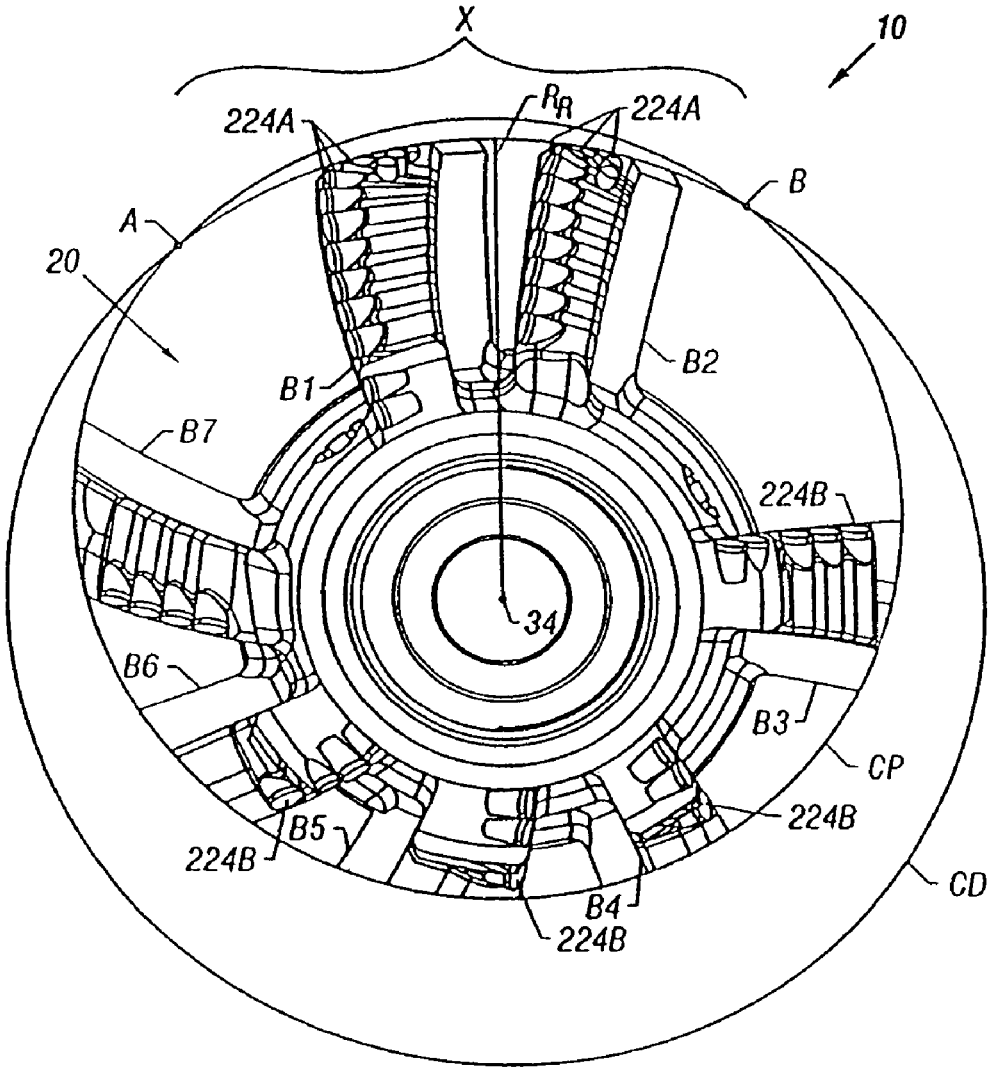
FIG. 3 shows an end view of a reaming section of the example reaming tool of FIG. 1.

FIG. 3 is an end view of the reaming section 20. In FIG. 3, the reaming blades are designated by numerals B1 through B7 to identify them individually. In making the reaming tool 10 according to one aspect of the invention, the outer surfaces of the reaming blades B1–B7 can first be machined such as on a lathe, or otherwise formed, so as to conform to a circle having the drill diameter, which is twice the largest lateral extent $R_R$ shown in FIG. 3 from the longitudinal axis 34 of any of the reaming blades B1–B7. The drill diameter of the reaming tool 10 is the diameter to which the drill hole will be opened by passage of the reamer blades B1–B7 as the reaming tool 10 rotates about the longitudinal axis 34. This conformance circle, the so-called "drill circle", is shown in FIG. 3 at CD. The drill circle CD is substantially coaxial with the longitudinal axis 34 of the reaming tool 10, as the reaming tool 10 rotates about the longitudinal axis 34 during drilling. The reaming blades B1–B7 are, in addition, shaped so that the reaming tool 10 can pass freely through an opening which is smaller than the drill diameter ($2\times R_R$). This diameter is referred to as the "pass through" diameter. A circle showing the opening through which the reaming tool 10 will pass is shown in FIG. 3 as the "pass-through circle" CP. To enable passage of the reaming tool 10 through the pass-through circle CP, the outer surfaces of the reaming blades B1–B7, after being formed to fit within the drill circle CD, can then be cut such as on a lathe, or otherwise formed, to conform to the pass-through circle CP. The pass-through circle CP, however, is axially offset from the drill circle CD (and the longitudinal axis 34) by an amount which results in some overlap between the circumferences of the pass through circle CP and circumference of the drill circle CD. The intersections of the pass-through circle CP and drill circle CD circumferences are shown at A and B in FIG. 3, and the overlapping section ("overlap section") is shown at X. Within the overlap section X, circumferentially between points A and B, any reaming blades so azimuthally located are shaped to conform to the drill circle CD, as within the overlap section X, the drill circle CD is radially less extensive from the longitudinal axis 34 than is the pass through circle CP. In this example, blades B1 and B2 are located azimuthally within the overlap section X. Outside the overlap section X, the reaming blades (B3–B7 in this example) conform to the pass-through circle CP because within this azimuthal range the pass through circle CP is radially less extensive from the longitudinal axis 34 than is the drill circle CD. The particular azimuthal locations of the reaming blades B1–B7 shown in FIG. 3 are only meant to illustrate the principle by which the reaming blades on the reaming tool 10 are formed. The specific azimuthal positions of the reamer blades, and the numbers of such reamer blades within and without the overlap section X shown in FIG. 3 are not meant to specifically limit the invention.

Because the reaming blades B1, B2 within the overlap section X conform to the drill circle CD, the radially outermost cutters 224A positioned on these blades B1, B2 can then be positioned on the leading edge (the edge of the blade which faces the direction of rotation of the reaming tool 10) thereof so that the cutter locations will trace a circle having the full drill diameter ($2\times R_R$) when the reaming tool 10 rotates about the longitudinal axis 34. The radially most extensive reaming blades B1, B2, however, are positioned azimuthally in the overlap section X, as previously explained. The drill circle CD defines, with respect to the longitudinal axis 34, the laterally outermost part of the reaming tool 10 at every azimuthal position, as previously explained. Therefore the blades B1, B2 within the overlap section X will extend only as far laterally as the radius of the drill circle CD. The radially outermost cutters 224A on blades B1 and B2 can be positioned at "full gauge", meaning that these cutters 224A are at the same radial distance from the longitudinal axis 34 as the outermost parts of the blade B1, B2 onto which they are attached, and will therefore cut a full drill diameter hole. However, the cutters 224A on blades B1, B2 are also disposed radially inward from the pass-through circle CP at these same azimuthal positions because of the limitation of the lateral extent of these blades B1, B2. Therefore, the outermost cutters 224A will not contact the inner surface of an opening having a diameter about equal to the pass-through diameter as the reaming tool 10 is moved through such an opening. The preferred shape of the radially outermost reaming blades B1, B2 and the position of radially outermost cutters 224A thereon enables the reaming tool 10 to pass freely through a protective casing (not shown) inserted into a wellbore, without sustaining damage to the outermost cutters 224A, while at the same time drilling a hole which has the full drill diameter ($2\times R_R$).

The reaming blades which do not extend to full drill diameter (referred to as "non-gauge reaming blades"), shown at B3–B7, preferably have their outermost cutters 224B positioned radially inward, with respect to pass-through circle CP, of the radially outermost portion of each such non-gauge reaming blade B3–B7 to avoid contact with any part of an opening at about the pass-through diameter. This configuration of blades B3–B7 and cutters 224B has proven to be particularly useful in efficiently drilling through equipment (called "float equipment") used to cement in place the previously referred to casing. By positioning the cutters 224B on the non-gauge reaming blades B3–B7 as described herein, damage to these cutters 224B can be avoided. Damage to the casing (not shown) can be also be avoided by arranging the non-gauge cutters 224B as described, particularly when drilling out the float equipment. Although the non-gauge reaming blades B3–B7 are described herein as being formed by causing these blades to conform to the pass-through circle CP, it should be understood that the pass-through circle only represents a radial extension limit for the non-gauge reaming blades B3–B7. It is possible to build the reaming tool 10 with radially shorter non-gauge reaming blades. However, it should also be noted that by having several azimuthally spaced apart non-gauge reaming blades which conform to the pass-through circle CP, the likelihood is reduced that the outermost cutters 224A on the gauge reaming blades B1, B2 will contact any portion of an opening, such as a well casing, having less than the drill diameter.

Another aspect of the invention is the use of cutters 224B positioned on the reaming blades B3–B7 located outside the overlap section X. Prior art reamer wings typically had blades substantially only on one side of the reamer. Any lateral extensions of prior art reamer wings in azimuthal positions away from the intended cutting area were typically in the form of pads having no cutting structures thereon. In this aspect of the invention, at least one cutter can be included on each reaming blade B3–B7 located outside the overlap section, even those reaming blades (such as B4–B6 in FIG. 3) which are azimuthally substantially opposite the gauge reaming blades B1, B2. The azimuthal positions of the blades B1–B7 shown in FIG. 3 are only an example of azimuthal positions which will work with this aspect of the invention, but this aspect of the invention will perform better when the blades B1–B7 are distributed around substantially all the circumference of the body 12. Preferably the cutters 224B on the non-gauge reaming blades B3–B7, as previously explained, should be located radially inboard of the outer edge of the non-gauge reaming blades to avoid damage thereto when the reaming tool 10 is passed through an opening having the pass through diameter. The purpose of including the cutters 224B on the non-gauge reaming blades B3–B7 is to provide azimuthally more balanced cutting force to the reaming tool 10 than is possible using only cutters on the gauge reaming blades B1, B2. By better azimuthally balancing the cutting forces, the drilling stability of the reaming tool 10 of this invention is improved over prior art reamer wings. The particular positions and/or orientations of the cutters 224A, 224B are preferably selected to minimize the overall net lateral force generated by the reaming section 20. Methods for selecting cutter orientations and positions are described in the Warren et al reference referred to earlier, for example.

Even using the cutters 224B on azimuthally distributed blades as shown in FIG. 3, the reaming section 20 will develop some net lateral force during drilling of earth formations. The net lateral force is a result of having a much larger number of cutters 224 concentrated on the gauge reaming blades B1, B2. In an aspect of the invention previously referred to, the positions and/or orientations of the intermediate gauge cutters (124 in FIG. 2) on the pilot hole conditioning section (18 in FIG. 2) are be selected to provide a net lateral force imbalance which within about twenty percent of axial force (referred to in the art as "weight on bit") applied to the reaming tool 10. More preferably, the net lateral force should be within about fifteen percent of the axial force on the reaming tool 10. Such force balancing enhances the drilling stability of the reaming tool 10 as compared to prior art reamer wings.

Another aspect of the invention is the shape of the reaming blades B1–B7. The preferred shape is spiral-like. No particular configuration of spiral is required, however it is preferred that the blades B1–B7 are shaped so that the cutters 224A, 224B aligned along a leading edge of the blade are not all at the same azimuthal position. Although the example shown in FIG. 3 has every blade being spirally shaped, it is within the contemplation of this invention that only selected ones of the blades can be spiral shaped while the other blades may be straight. Each cutter on any such straight reaming blade may be at the same azimuthal position as the other cutters thereon.

The reaming blades which do not extend to full drill diameter, B3–B7 in FIG. 2, preferably include inserts 122 on their laterally outermost surfaces. The inserts 122 can be made from polycrystalline diamond, tungsten carbide, or other hard, wear resistant material. The inserts 122 reduce wear on the surfaces of the reaming blades B3–B7, particularly when the reaming tool 10 is moved through casing or any other opening having approximately the pass-through diameter.

Referring once again to FIG. 2, another aspect of the invention will be explained. At least some of the blades 22 in the reaming section 20 can be formed into the same structure as the corresponding one of the blades in the pilot hole conditioning section 18. Some of the reaming section 20 blades may not be formed as continuations of a corresponding pilot hole conditioning section blade, depending on the number of and azimuthal positions of the blades in the pilot hole conditioning section 18.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A reaming tool, comprising:

a body adapted to couple to a drill string at both axial ends thereof, the body having a plurality reaming blades affixed thereto, selected ones of the plurality of reaming blades having at least one cutter attached thereto at a selected positions and orientations, the plurality of reaming blades comprising at least one radially most extensive reaming blade; and comprising a pilot blade azimuthally spaced apart from the at least one radially most extensive reaming blade, the pilot blade affixed to the body longitudinally ahead of the at least one radially most extensive reaming blade.

2. The reaming tool of claim 1, wherein the at least one cutter attached to selected ones of the plurality of reaming blades is at a selected position and orientation to minimize a net lateral force developed by the reaming tool.

3. The reaming tool of claim 1, wherein the pilot blade includes a gauge pad having a diameter substantially equal to a drill diameter of a pilot bit used to drill a pilot hole longitudinally ahead of the reaming tool.

4. The reaming tool of claim 1, wherein selected ones of the plurality of reaming blades comprise a spiral structure.

5. A reaming tool, comprising:

a body adapted to couple to a drill string at both axial ends thereof; and a plurality of reaming blades affixed to the body, the plurality of reaming blades comprising:

at least one radially most extensive reaming blade defining a drill circle substantially coaxial with a longitudinal axis of the body; and at least two radially less extensive reaming blades azimuthally spaced apart so as to define a pass-through circle smaller than and axially offset from the drill circle, wherein the at least one radially most extensive blade substantially avoids contact when passing through an opening having a diameter substantially equal to a diameter of the pass-through circle.

6. The reaming tool of claim 5, wherein selected ones of the at least one radially most extensive reaming blade comprise wear resistant inserts on laterally outermost surfaces thereof.

* * * * *